United States Patent [19]

Huhn et al.

[11] Patent Number: 4,575,978

[45] Date of Patent: Mar. 18, 1986

[54] POLE SHELL BUILDING

[76] Inventors: John H. Huhn; George Spector, both of 233 Broadway, RM 3615, New York, N.Y. 10007

[21] Appl. No.: 594,368

[22] Filed: Mar. 28, 1984

[51] Int. Cl.[4] ..... E04B 1/18

[52] U.S. Cl. ..... 52/234; 52/236.7; 52/301

[58] Field of Search ..... 52/234, 236.7, 236.8, 52/236.1, 250-252, 259, 263, 283, 723, 336, 301, 296, 297, 236.3

[56] References Cited

U.S. PATENT DOCUMENTS

| | | | |
|---|---|---|---|
| 225,060 | 3/1880 | Johnson | 52/283 |
| 467,141 | 1/1892 | Seely | 52/252 |
| 938,458 | 11/1909 | Brockhausen | 52/723 |
| 1,019,561 | 3/1912 | Tresidder | 52/301 |
| 1,863,258 | 6/1932 | Tashjian | 52/336 |
| 1,982,343 | 11/1934 | Kane | 52/252 |
| 4,196,558 | 4/1980 | Jungbluth | 52/723 |

FOREIGN PATENT DOCUMENTS

| | | | |
|---|---|---|---|
| 1517313 | 2/1968 | France | 52/296 |

*Primary Examiner*—James L. Ridgill, Jr.

[57] ABSTRACT

A pole shell building having a plurality of floors is provided and consists of a plurality of pole shell columns, each column affixed at bottom to a concrete slab, a plurality of support plates, each plate affixed to top of each column, a plurality of trusses, each truss supported at short spans between two support plates and a plurality of beams each beam supported at long spans between two support plates and a concrete slab supported by the trusses and beams.

1 Claim, 4 Drawing Figures

POLE SHELL BUILDING

BACKGROUND OF THE INVENTION

The instant invention relates generally to buildings and more specifically it relates to a pole shell building having a plurality of floors.

The fabrication of buildings in the construction field are designed by utilizing two factors. One is safety and the other is low cost of materials. To accomplish this the present invention has been fashioned.

SUMMARY OF THE INVENTION

A principle object of the present invention is to provide a pole shell building having a plurality of floors that utilizes structural materials that are designed for safety.

Another object is to provide a pole shell building having a plurality of floors that utilizes structural materials that are low in cost.

An additional object is to provide a pole shell building having a plurality of floors that utilizes steel pole shell columns.

A further object is to provide a pole shell building having a plurality of floors that utilizes a support plate that contains reinforcement ribs to add support to the plate.

A still further object is to provide a pole shell building having a plurality of floors that utilizes a support plate that contains a collar for easy assembly of the plate to the column.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
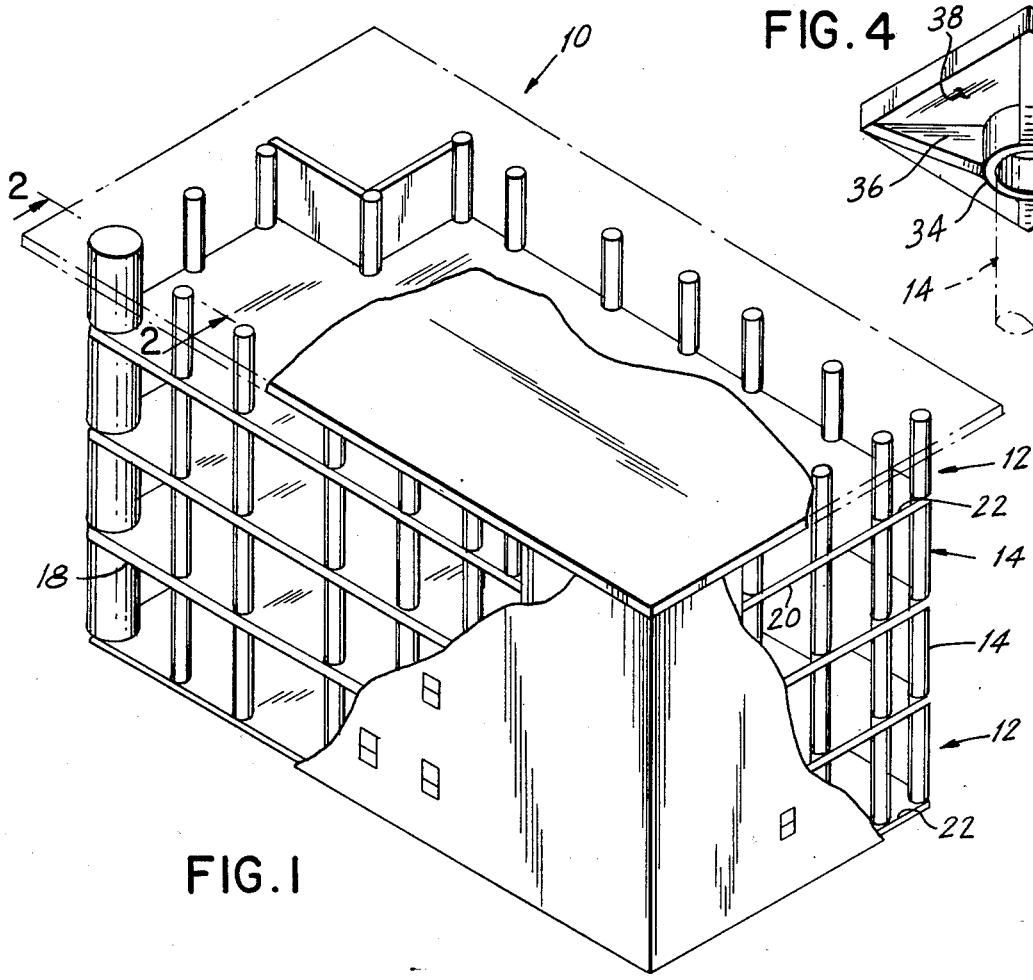
FIG. 1 is a perspective view of the invention with parts broken away.
Figure 2:
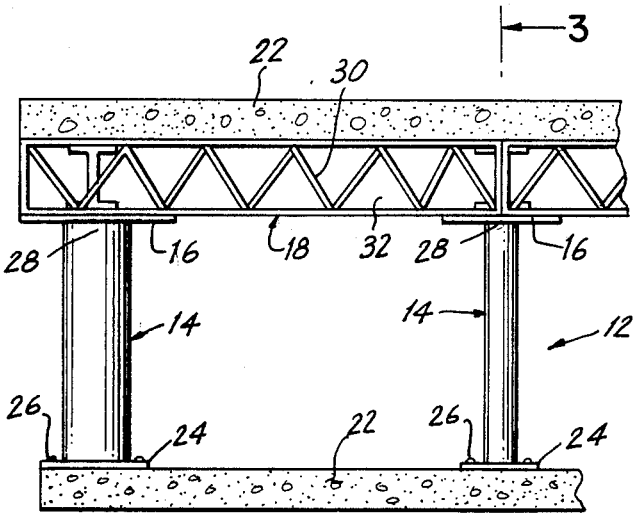
FIG. 2 is a cross sectional view taken along line 2—2 in FIG. 1.
Figure 3:
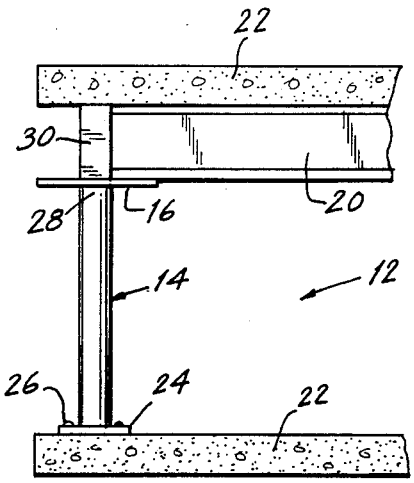
FIG. 3 is a cross sectional view taken along line 3—3 in FIG. 2.

Turning now descriptively to the drawings, in which similar reference characters denote similar elements throughout the several views, FIGS. 1 through 3 illustrates a pole shell building 10 having a plurality of floors 12. Each floor 12 basically consists of a plurality of pole shell columns 14, a plurality of support plates 16, a plurality of trusses 18, a plurality of beams 20 and a concrete slab 22.

Each column 14 is affixed at bottom 24 with rivets 26 to a concrete slab 22 and each plate 16 is affixed to top 28 of each column 14. Each truss 18 is supported at short spans between two support plates 16 and 16 while each beam 20 is supported at long spans between two support plates 16 and 16. A concrete slab 22 is supported by the trusses 18 and beams 20.

The pole shell columns 14 are made of steel and the beams 20 are made of steel I-beams. Each truss 18 is made of an assemblage of steel channel members 30 arranged in triangular combinations 32 to form a rigid frame work.

Figure 4:
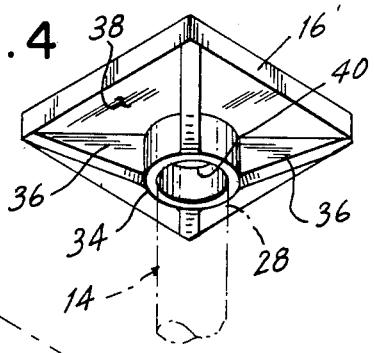
FIG. 4 is a perspective view of a modification of the support plate.

FIG. 4 shows a modified support plate 16'. The support plate 16' contains a collar 34 having a plurality of reinforcement ribs 36 formed from underside 38 of the plate 16' to add support to the plate 16'. The collar 34 can slip over the top 28 of each column 14 for easy assembly. Shim plates 40 are used to adjust elevation of plate 16.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A pole shell building having a plurality of floors wherein each floor comprises:

(a) a plurality of pole shell columns, each column affixed at bottom to concrete slab;

(b) a plurality of support plates, each plate affixed to top of each column;

(c) a plurality of trusses, each truss supported at short spans between two support plates; and (d) a plurality of beams, each beam supported at long spans between two support plates; and (e) a concrete slab supported by the trusses and beams;

(f) a means for adjusting plate elevation wherein each support plate further includes a collar affixed to underside having a plurality of reinforcement ribs formed thereof at the underside of said plate extending from the collar to the edges of said plate to reinforce said plate, said collar fitting over the top of each column for easy assembly, in further combination with shims fitting inside said collar to engage said columns.

* * * * *